US007996966B2

(12) United States Patent
Jensen et al.

(10) Patent No.: US 7,996,966 B2
(45) Date of Patent: Aug. 16, 2011

(54) STRIP BUNDLES

(75) Inventors: Glen Jensen, Winona, MN (US); Larry Mollan, Menomonie, WI (US)

(73) Assignee: Wincraft, Inc., Winona, MN (US)

( * ) Notice: Subject to any disclaimer, the term of this patent is extended or adjusted under 35 U.S.C. 154(b) by 352 days.

(21) Appl. No.: 12/119,980

(22) Filed: May 13, 2008

(65) Prior Publication Data

US 2009/0282661 A1 Nov. 19, 2009

(51) Int. Cl.
*D04D 9/00* (2006.01)

(52) U.S. Cl. ..... 28/247; 28/147; 28/220

(58) Field of Classification Search ..... 28/147, 28/247, 259, 260, 258, 261, 220, 248, 252; 223/46; 264/168, 282; 57/351, 59, 58.67, 57/58.63, 65, 205, 283, 282
See application file for complete search history.

(56) References Cited

U.S. PATENT DOCUMENTS

| | | | | |
|---|---|---|---|---|
| 2,062,183 | A | 11/1936 | Lawson et al. | |
| 2,335,219 | A | 11/1943 | Abramson | |
| 2,881,504 | A * | 4/1959 | Billion | 28/278 |
| 2,903,841 | A * | 9/1959 | Mayner | 57/2.5 |
| 2,979,882 | A * | 4/1961 | Bromley et al. | 57/310 |
| 2,983,026 | A * | 5/1961 | Skalko | 65/102 |
| 3,147,581 | A * | 9/1964 | Godderidge | 57/58.63 |
| 3,234,626 | A * | 2/1966 | Faria | 28/221 |
| 3,355,872 | A * | 12/1967 | Gilchrist et al. | 57/283 |
| 3,457,134 | A | 7/1969 | Karkoska | |
| 3,479,709 | A * | 11/1969 | Daniel | 28/259 |
| 3,484,329 | A | 12/1969 | Boisse | |
| 3,591,904 | A | 7/1971 | Rosene | |
| 3,780,514 | A | 12/1973 | Rodermund et al. | |
| 4,287,647 | A | 9/1981 | Rodermund et al. | |
| 4,369,215 | A | 1/1983 | Offen et al. | |
| 4,427,724 | A | 1/1984 | Stark et al. | |
| 4,786,535 | A | 11/1988 | Young | |
| 4,896,802 | A | 1/1990 | Nanami | |
| 5,261,578 | A * | 11/1993 | Monahan | 223/46 |
| 6,298,639 | B1 * | 10/2001 | Shea | 53/520 |
| 6,360,413 | B1 * | 3/2002 | Lopata et al. | 28/147 |
| 6,908,018 | B1 * | 6/2005 | Barrett | 223/46 |
| 7,150,140 | B2 * | 12/2006 | Harmon | 57/59 |

* cited by examiner

*Primary Examiner* — Amy B Vanatta
(74) *Attorney, Agent, or Firm* — Fredrikson & Bryron, PA

(57) ABSTRACT

A machine for creating a bundle of creased strips of material and handles for use with bundles of creased strips and other applications. Also contemplated are bundles of strips with or without handles for various applications.

7 Claims, 3 Drawing Sheets

STRIP BUNDLES

BACKGROUND

Decorative strip bundles are used in many applications and may be most popularly recognized as pom pons used, for example, for cheering at a sporting event. The bundles of strips may come in various sizes and configurations and may be made of materials such as plastic strips, metallic strips, and metallic strips with holographic or other images printed on them, and others.

In most cases, it is advantageous for the bundle of strips to have some rigidity to provide a three-dimensional appearance and effect while still providing movement as the pom is shaken.

SUMMARY

In one embodiment in accordance with the invention, a machine for creating a bundle of creased strips includes a strip supply source capable of supplying a twisted strip of material, a crimp surface over which the twisted strip of material is passed, and a strip accumulation device for accumulating the strip after it has passed over the crimp surface.

In another embodiment in accordance with the invention, a machine for creating a bundle of creased strips includes a strip supply source capable of supplying a twisted strip of material, a crimp surface over which the twisted strip of material is passed, and a strip accumulation device for accumulating the strip after it has passed over the crimp surface. In this embodiment the strip supply source has a revolving reel of strip material. In variations of this embodiment, more than one, and possibly four, revolving reels of strip material may be used.

In yet another embodiment, a machine for creating a bundle of creased strips includes a strip supply source capable of supplying a twisted strip of material, a crimp surface over which the twisted strip of material is passed, and a strip accumulation device for accumulating the strip after it has passed over the crimp surface. In this embodiment the crimp surface is a roller. In variations of this embodiment the crimps surface could be textured with a pattern.

In another embodiment in accordance with the invention, a method of creating a decorative bundle of strips includes twisting a strip of material and drawing the twisted strip of material across a crimp surface. The method also involves wrapping the strip of material around a take-up reel to from a roll of material on a reel and gathering the roll of material within a retainer that is oriented perpendicularly to the strips of material making up the roll. The roll of material is then cut at a point generally opposite the retainer to create a bundle of strips bound together at their approximate centers by the retainer.

In still another embodiment in accordance with the invention, a handle portion has a first handle portion body from which a tab extends and a slot located on the handle portion body. The body has an opening configured to accept and retain a cable tie gear rack. The tab and slot of this embodiment are located so that a second handle portion body may be attached to the first handle portion body by engaging the tabs of each handle portion with the slots of the other handle portion.

DETAILED DESCRIPTION

Embodiments of the invention relate to a machine for producing bundles of decorative strips of material attached to a handle, as in a pom pon. The "fluffing" of pom pons and similar devices by manually creasing individual strips or rubbing the bundle on a textured surface can be used to enhance the three-dimensional effect of the bundles of strips. These techniques can be time-consuming and can produce inconsistent results and appearances for the final product. Machines in accordance with embodiments of the invention may twist strips of material and pass the twisted strips over crimp surfaces to crease the strips in a generally longitudinal but skew fashion. Strips can be crimped in a more consistent fashion, although still somewhat randomly and crimp angle and severity can be adjusted to achieve a desired appearance.

Figure 1:
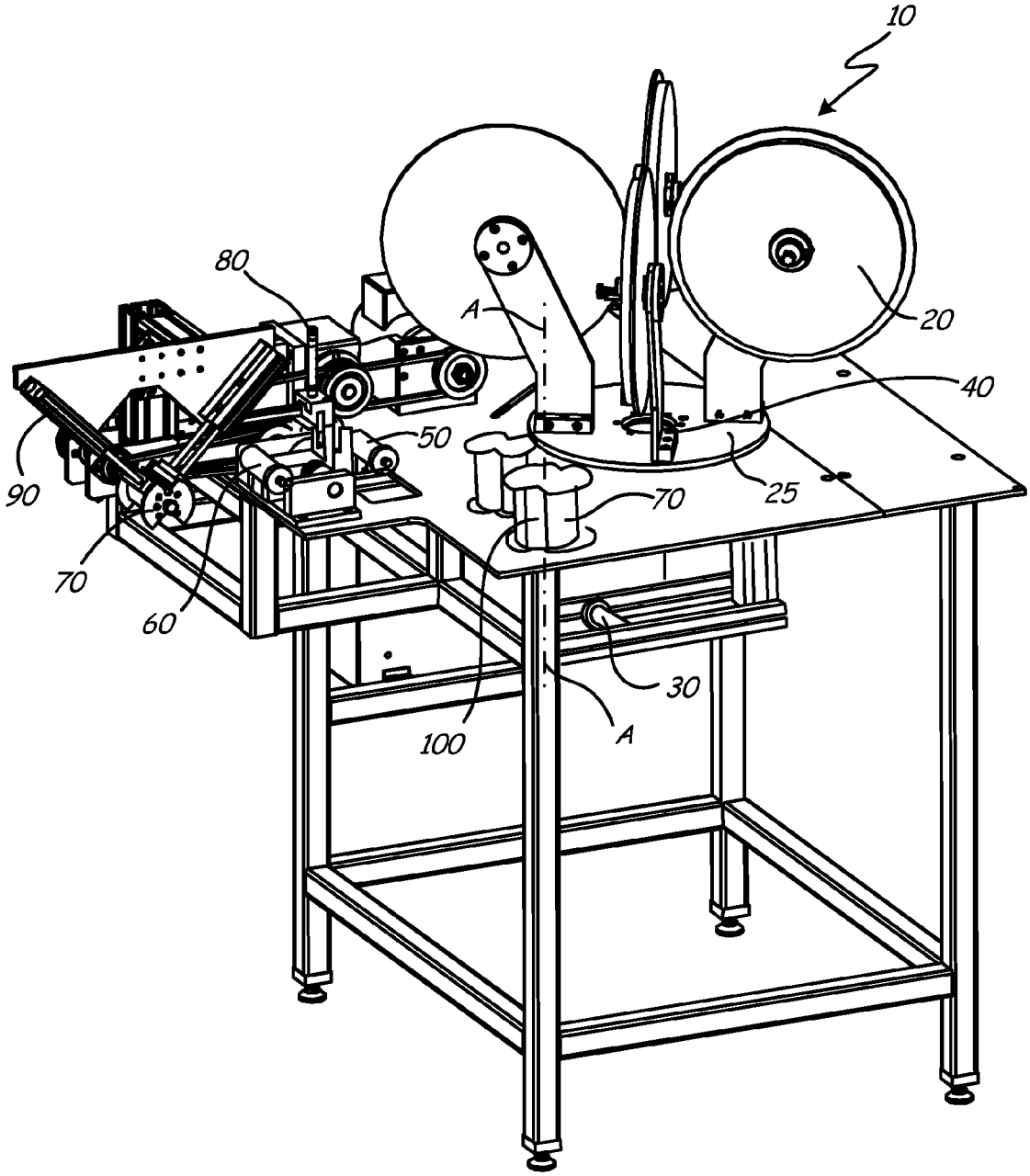
FIG. 1 is a perspective view of a machine in accordance with embodiments of the invention.

Turning now to the Figures, FIG. 1 is a perspective view of a machine in accordance with embodiments of the invention. The machine 10 has a revolving reel 20 that revolves around a collection region 40. Strip material is drawn from the reel 20 as the wheel revolves around the collection region 40, and the material is twisted as it passes through the collection region 40. The embodiment shown in FIG. 1 has four reels 20, but conceivably any number of reels, including one, could be used. In embodiments where multiple reels 20 are employed, the strips coming off of the reel are twisted together generally at the collection point 40.

The rate that the material is drawn from the reel 20 relative to the rate that the reel 20 revolves around the collection point 40 determines the number of twists per unit length of strip and ultimately the angle of the creases formed in the strip. For example, if a reel makes one revolution per foot of strip material drawn off, the strip will have one twist per foot and have a certain average crease angle once creased. If the reel makes two revolutions per foot of strip material, the angle of the ultimate crease relative to the strip will be greater.

In the embodiment shown in FIG. 1, four reels 20 are mounted on a belt-driven turntable 25. Any supply source capable of providing a twisted strip of material could be used, but the arrangement shown in FIG. 1 has the advantage of allowing for multiple strips to be twisted together. This arrangement also provides for simple switching out of feedstock material depending on consumer preferences and the like.

The reel 20 of this embodiment may be mounted with a wear plate and springs or an analogous tension maintaining device so that operators can adjust the amount of tension it takes to pull the strips from the reel. By making this adjustment, the pressure with which the strip of material is drawn across the crimp surface 30 may be adjusted and the severity of the crimps or creases may be adjusted until a desired appearance is reached.

Once the material is twisted it passes over a crimp surface 30. When the strip is described as passing over a crimp surface, the word "over" is intended to connote only contact with the surface and not relative height of the strip to the surface. In the embodiment in FIG. 1, crimp surface 30 is a roller, and the material passes under the roller but "over" the crimp surface 30. When the twisted material is drawn over the roller the roller forms creases in the material. Any crimp surface could be used, including but not limited to rotating surfaces with geographic (i.e., triangular, square) cross sections that place transverse creases in the strip while the material is drawn over them, stationary surfaces, textured rotating or stationary surfaces, or surfaces designed to puncture the strip, for example.

In the embodiment shown in FIG. 1, the creased strip of material passes from the crimp surface 30 to a roller 50 that may also act as a crimp surface. From roller 50 the strip is adjusted by level winder 80. The level winder 80 synchronizes back and forth linear movement with spool rotation to wind the strip onto take-up reel 70. The level winder 80 is designed to provide smooth, even spooling of the strip onto the take up reel 70 with reduced material build-up or "valleys" across the surface of the take-up reel 70.

The take-up reel 70 may be powered by a drive belt or other means of delivering a motive force. As strip is initially fed through the machine 10 to the take-up reel 70. In some embodiments, the take up reel 70 draws the strip through the machine 10, while the source of supply for the strip provides tension to provide for appropriate crimping of the strip.

Once the appropriate amount of strip is collected on the take up reel 70, the reel is stopped. In one exemplary embodiment, the reel may be brought to a stop using reciprocal plungers 90 that extend to contact the reel 70 and, optionally, to secure the strip on the reel 70.

It may be advantageous for some applications to have a take-up reel 70 of some width. If the take up reel is too narrow, strip that is taken up by the reel later in the process will be wrapped around strip that is already around the take-up reel, resulting in a longer strip each time around the take-up reel due to the larger circumference of the reel plus the strip. If the roll of strip is to be used to create a pom pon, the longer strips may detract from the appearance of the finished product.

In some embodiments, the reel 70 has a generally cylindrical portion oriented about axis A. The generally cylindrical portion of this embodiment is interrupted by two channels 100, the channels being oriented generally parallel to axis A. In this embodiment the strip could be gathered by placing a retainer in the channel between the roll of strip and the reel 70. The retainer could be any retainer capable of retaining the collection of strips, but in a preferred embodiment the retainer could be a cable tie.

Figure 2:
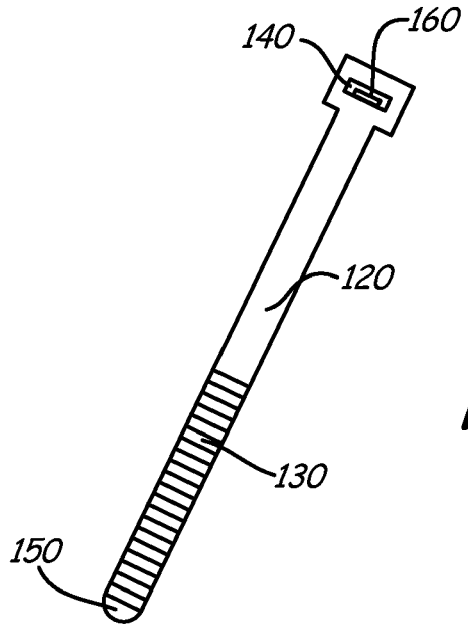
FIG. 2 is a plan view of a cable tie in accordance with embodiments of the invention.

FIG. 2 is a plan view of a cable tie in accordance with embodiments of the invention. In some embodiments, a cable tie 110 consists of a sturdy strap 120 with an integrated gear rack 130 on one end and a ratchet 160 within an opening 140. The end of the tie with the gear rack may have a tip 150. The tip 150 may, but need not be, pointed to allow for easier insertion into openings. Cable ties may be made of several materials including but not limited to ethylene tetrafluoroethylene (ETFE), ethylene chlorotrifluoroethlyene (ECTFE) and Nylon.

In the event that the retainer is a cable tie 110, the cable tie may be placed in the channel 100 between the roll of strip and the reel 70. The cable tie is then bent around the bundle of strips until the tip 150 can be inserted into the opening 140. Once the gear rack 130 engages with the ratchet 160 it is essentially prevented from being pulled back and the resulting loop may only be pulled tighter.

Once the strips are bound within the retainer, a cutting tool may be placed in the other channel 100 to cut the strips. This results in a bundle of strips bound together by the retainer at their approximate centers. Take up reels 70 of various sizes may be used to produce bundles of strips of various lengths. For example, a take-up reel 70 that is eight inches in circumference will result in a bundle of eight inch strips bound at their approximate centers. By changing the reel 70, one can change the length of the strips because the circumference of the take-up reel is different.

Figure 3:
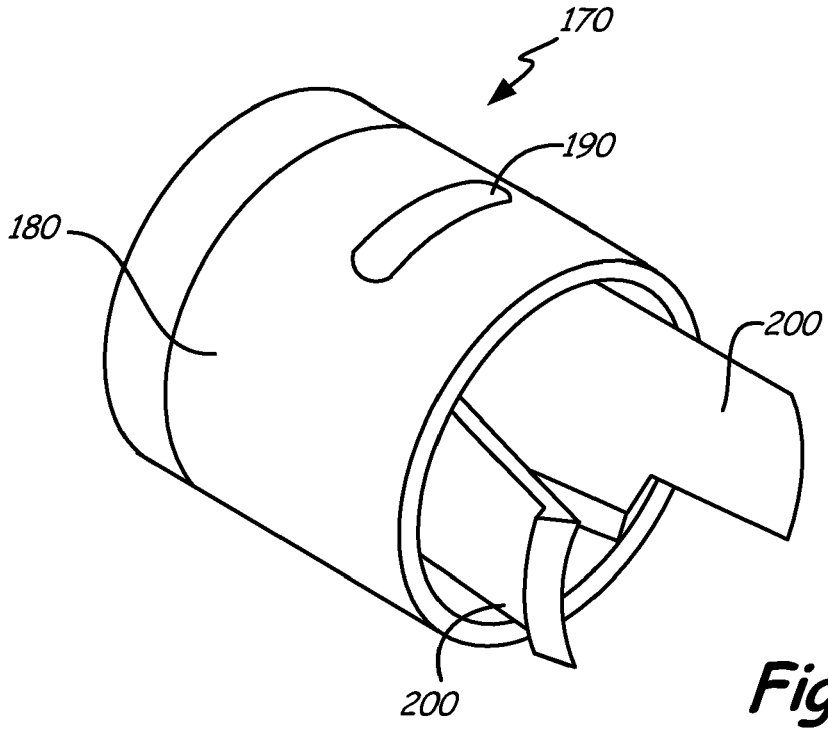
FIG. 3 is a perspective view of a handle portion in accordance with embodiments of the invention.

FIG. 3 is a perspective view of a handle portion in accordance with embodiments of the invention. The handle portion of this embodiment has a generally cylindrical body 180 from which extend a tab 200 or a plurality of tabs 200. In this embodiment two tabs are shown, but any number of tabs could be used. The body has a slot 190 or a plurality of slots 190 (one shown) located on it. The tabs 200 and slots 190 are configured so that two identical handle portions 170 can be joined into one handle by aligning the tabs 200 of one handle portion 170 with the slots 190 of a second handle portion 190 and moving them together so that the tabs 200 of each handle portion engage with the slots 190 of the other handle portion.

Figure 4:
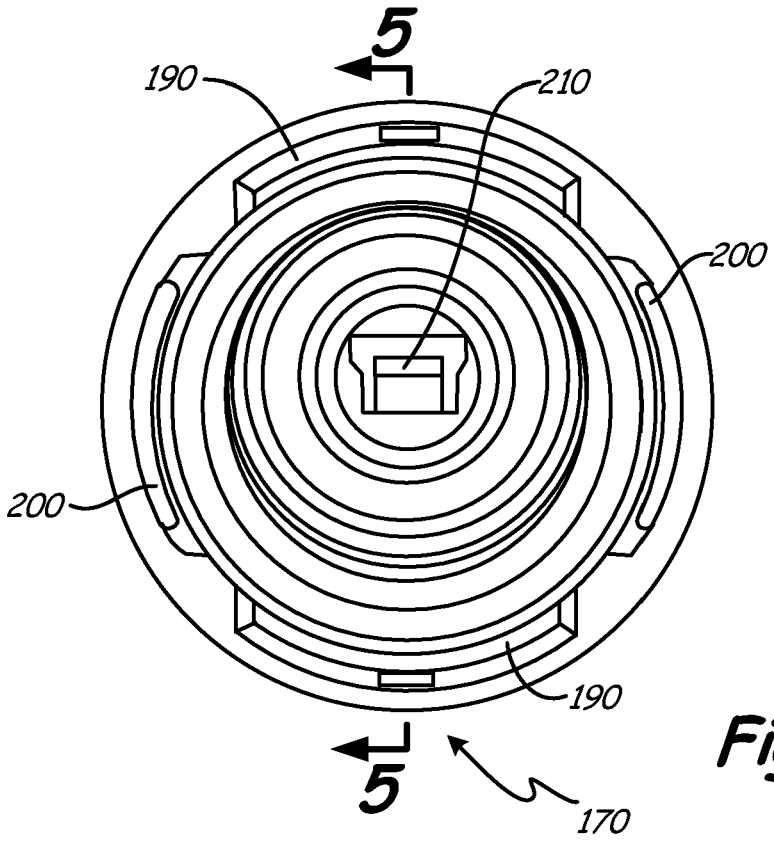
FIG. 4 is an end view of the handle portion of FIG. 3.

FIG. 4 is an end view of the handle portion of FIG. 3. The tabs 200 and slots 190 are oriented generally at the perimeter of the handle portion 170. An opening 210 is configured to receive the end 150 of a cable tie such as is described in connection with FIG. 2.

Figure 5:
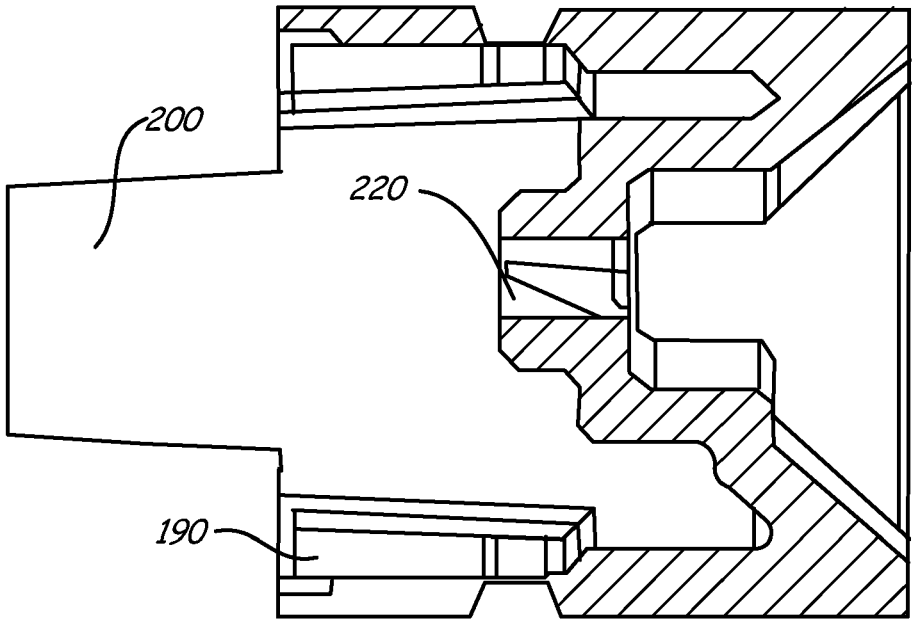
FIG. 5 is a cross section of the handle portion of FIG. 4 taken at line 5-5.

FIG. 5 is a cross section of the handle portion of FIG. 4 taken at line 5-5. The tab 200 and slots 190 are shown, and a ratchet 220 for retaining the gear rack 130 of a cable tie such as is described in connection with FIG. 2.

Handle portions such as those shown in FIGS. 3, 4, and 5 may be used to retain anything that is secured by a cable tie. As describe above, a cable tie may secure objects such as, but not limited to, a bundle of strips by wrapping the cable tie around the object and inserting an end of the cable tie having a gear rack into an opening located on the other end of the cable tie. The end having the gear rack can then be pulled through the opening until a desired tightness is achieved. Once a cable tie has secured an object or collection of objects, the excess strap can be inserted into the opening 210 of a handle portion 170 and pulled through the other side. This strap can be pulled through the handle portion 170 and tightened to a desired degree. This tightening may be done manually or by a cable tie tensioning device as is known in the art. Once the cable tie is secure to a handle portion, the excess strap may be cut off. Some cable tie tensioning devices include the capability to repeatedly cut remove all but a desired length of excess strap.

After securing the cable tie and its contents to a handle portion and optionally tensioning and cutting off excess cable tie strap, a second handle portion can be affixed to the handle portion retaining the cable tie through the use of a tab and slot configuration as described above. Adhesives, stickers, welding, and other means of securing the handle portions together may optionally be employed and will occur to those of skill in the art upon reading this disclosure.

As a non-limiting example, strips crimped and gathered on a take-up reel as described with respect to FIG. 1 could be formed into a pom pon by pulling the excess strap of a cable tie that is securing a bundle of crimped strips through the opening 210 of a handle portion 170. The strap can be tensioned and/or cut if desired. A second handle portion can be secured to the handle portion into which the cable tie was inserted, and a bundle of crimped strips secured by a handle, or a pom pon, is produced.

Crimped strips formed by, for example, a machine such as that disclosed in FIG. 1, will "fluff" and take on a pleasing three-dimensional effect. Crimping, bundling, and securing crimped strips to a handle as can be accomplished using the above disclosed structures can produce a aesthetically pleasing pom pon of high quality in a repeatable and efficient fashion.

A cable tie tensioning device or tool may be used to apply a cable tie with a specific degree of tension. The tool may cut off the extra tail flush with the head in order to avoid a sharp edge which might otherwise cause injury.

What is claimed is:

1. A machine for creating a bundle of creased strips comprising:

a. a strip supply source capable of supplying a twisted strip of material, the strip supply source comprising a revolving reel of strip material and a collection region;

b. a crimp surface over which the twisted strip of material is passed; and c. a strip accumulation device for accumulating the strip after it has passed over the crimp surface, configured to draw the strip material over the crimp surface under tensive pressure; and wherein the strip supply source is configured to rotatably twist the strip material as it passes through the collection region and the machine is configured to form skewed, longitudinal creases in the twisted strip of material as it passes over the crimp surface.

2. The machine of claim 1, wherein four revolving reels of strip cooperate to supply a twisted strip of material comprising four individual strips.

3. The machine of claim 1, wherein the crimp surface is a roller.

4. The machine of claim 3, wherein crimp surface is textured with a pattern to emboss the strip.

5. The machine of claim 1, wherein the strip accumulation device is a take-up reel.

6. The machine of claim 5, wherein the take-up reel comprises a generally cylindrical portion having an axis, the generally cylindrical portion being interrupted by two channels formed in the exterior of the cylindrical portion parallel to the axis.

7. The machine of claim 5, further comprising a level winder to direct strip material to the take-up reel.

* * * * *